US005190292A

United States Patent [19]

Perry

[11] Patent Number: 5,190,292

[45] Date of Patent: Mar. 2, 1993

[54] SHOPPING BOARD GAME APPARATUS

[76] Inventor: Melody J. Perry, 18516 79th Pl. West, Edmonds, Wash. 98026

[21] Appl. No.: 836,783

[22] Filed: Feb. 13, 1992

[51] Int. Cl.[5] ..... A63F 3/00

[52] U.S. Cl. ..... 273/256; 273/243

[58] Field of Search ..... 273/242, 243, 248, 249, 273/251, 252, 254, 256, 278

[56] References Cited

U.S. PATENT DOCUMENTS

| | | | |
|---|---|---|---|
| 1,092,642 | 4/1914 | Gibson | 273/243 |
| 1,125,867 | 1/1915 | Mohr | 273/243 |
| 1,498,591 | 6/1924 | Thorn | 273/256 |
| 3,367,662 | 2/1968 | Charles et al. | 273/256 |
| 3,468,540 | 9/1969 | Mulligan | 273/256 |
| 3,656,751 | 4/1972 | Glass et al. | 273/243 |
| 3,990,707 | 11/1976 | Terilli | 273/256 |
| 3,994,499 | 11/1976 | Barlow | 273/256 |
| 4,003,577 | 1/1977 | Bolach | 273/243 |
| 4,452,457 | 6/1984 | Stieh et al. . | |
| 4,480,838 | 11/1984 | Sheronian . | |
| 4,566,697 | 1/1986 | Vickers . | |
| 4,824,118 | 4/1989 | Fusaro et al. . | |
| 4,856,788 | 8/1989 | Fischel . | |

FOREIGN PATENT DOCUMENTS 3210011 9/1983 Fed. Rep. of Germany ..... 273/256

*Primary Examiner*—Vincent Millin
*Assistant Examiner*—William E. Stoll

[57] ABSTRACT

A board game in which the game board is marked to form an endless main path simulating the main corridor of a shopping mall. Additional markings define endless branch paths simulating individual stores in the shopping mall. Playyers acquire the right to purchase specific items of merchandise in the branch paths by landing on specific spaces in the main path and picking merchandise items cards from a pack of cards. Other spaces on the main path direct the player to a spinner mechanism which can be used to obtain play money with which to purchase specific items of merchandise. The aim of the game is to purchase the highest possible dollar value of merchandise.

8 Claims, 1 Drawing Sheet

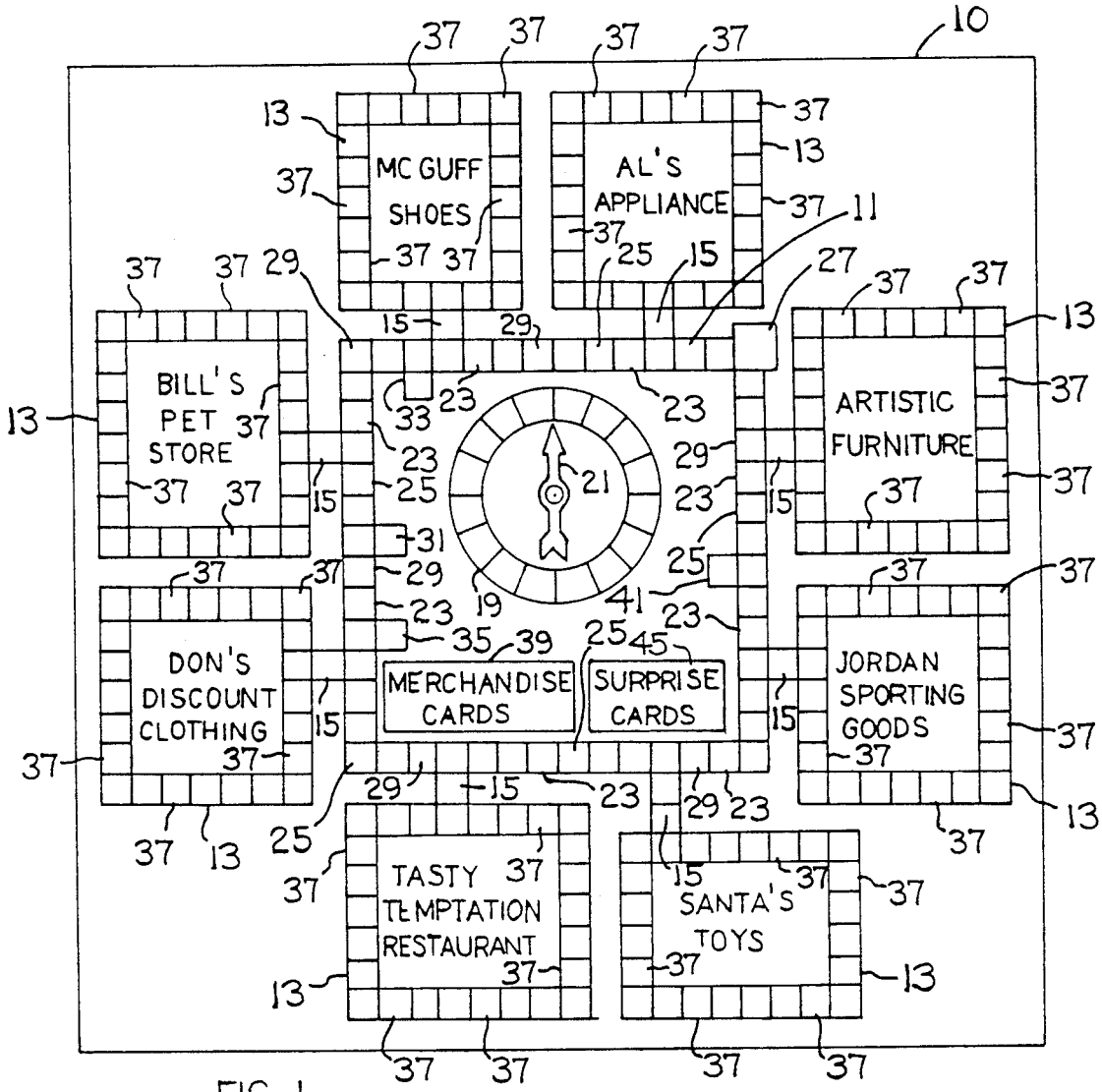
FIG. 1
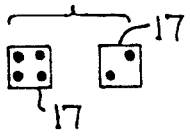
FIG. 2
| FREQUENT SHOPPER CARD | |
|---|---|
| ITEM | $ AMOUNT |
| | |
| | |
| | |
| | |
| | |
| | |
| TOTAL | |
FIG. 3

SHOPPING BOARD GAME APPARATUS

BACKGROUND AND SUMMARY OF THE INVENTION

This invention relates to a board game wherein each player has a token that can be moved along a main path and a series of branch paths marked on the game board surface. The main path is marked to simulate the main corridor of a shopping mall, whereas the branch paths are marked to simulate individual stores in the shopping mall.

Various board games have been devised, e.g. the well known game called MONOPOLY. Other board games are shown in U.S. Pat. Nos. 4,452,457 to Atieh et al, 4,480,838 to A. Aharonian, 4,566,697 to K. Vickers, 4,856,788 to M. Fischel.

The present invention relates to a board game wherein the game board is marked to simulate a shopping mall. A main endless path is marked on the board to represent the main corridor of the shopping mall. Branch paths connect with the main path at spaced points therealong; each branch path represents an individual store in the mall, e.g. a clothing store or an appliance store. Each path is subdivided into discrete spaces adapted to accommodate a player's token. Each player rolls a set of device to determine how many spaces his/her token will be advanced along the main path or a selected branch path during each player's turn.

Some of the spaces in the main path are marked to direct the player landing thereon to pick a card from a pack of Merchandise Cards. When the player receives such a card he/she is entitled to move the token along a path leading to a space in one of the branch paths marked with the particular item of merchandise indicated on the card. The winning player is the person who accumulates the greatest merchandise dollar value in a given period of time. Alternately, the winner can be the first player to accumulate a given merchandise dollar value.

The game board is designed so that each player is given multiple choices as to how his/her token is advanced along the board. The game involves a combination of luck and skill.

THE DRAWINGS

FIG. 1 is a plan view of the game board used in playing a game embodying the invention.

FIG. 2 shows a pair of dice that can be used in playing the game associated with the FIG. 1 game board.

FIG. 3 is a plan view of a score sheet that can be used with the FIG. 1 game board.

DESCRIPTION OF A PREFERRED EMBODIMENT OF THE INVENTION

FIG. 1 shows a game board 10 having markings thereon defining an endless main path 11 simulating the main corridor or a shopping mall. The illustrative path is an annular rectangular path occupying a central portion of the board, leaving a surrounding space free for branch paths simulating individual stores in the shopping mall.

Main path 11 is subdivided into fifty two discrete spaces (thirteen spaces on each of the four sections in the rectangle); these spaces are adapted to accommodate tokens controlled by the game players after roling a pair of dice 17 (FIG. 2). There are four additional spaces suitably marked to designate a restroom, drinking fountain, pay phone, and resting seat area. In the drawing numeral 31 designates the restroom, numeral 33 designates the drinking fountain, numeral 35 designates the pay phone, and numeral 41 designates the resting area. The areas designated by numerals 31, 33, 35 and 41 may be offset from main path (corridor) 11 as shown in FIG. 1.

Additional markings are provided on game board 10 to define eight endless branch paths 13, representing individual stores in the shopping mall. Each store markets different items of merchandise, e.g. shoes, or appliances, or toys, etc. Each branch path 13 is subdivided into discrete spaces for accommodating tokens controlled by the players. Each branch path 13 has a store entrance connection space 15 contiguous to the endless main path 11, such that any player can move his/her token from the main path into any selected branch path. Alternately, the player can move his/her token from any branch path through the respective space 15 and back onto the main path.

Each player advances his/her token along a selected path by rolling two dice 17 (FIG. 2), and advancing the token the number of spaces indicated by the dice. Each player begins play with his/her token on a mall entrance space 27 (upper right corner of path 11). The player can move his/her token in either direction along a given path, i.e. left, right, up or down in FIG. 1.

There is a first group of spaces 23 in path 11 marked to direct the player to use a cash machine spinner assembly 19. When a player's token lands (end up) on any one of the eight spaces 23 he/she is required to rotate spinner 21. Different dollar values are printed around the periphery of spinner assembly 19 for registry with spinner 21; the player receives from a play bank an amount of play money corresponding to the value designated by spinner 21.

There is a second group of spaces 29 in path 11 marked to direct the player landing thereon to receive a card entitling the player to purchase a designated item of merchandise. A pack of cards 39, herein designated as merchandise cards, is placed on the game board for use by the player landing his/her token in any of the six spaces 29 spaced along path 11. When a player's token lands (ends up) on a space 29 he/she picks a card from the pack of cards 39 and retains it for future reference. Each card identifies a specific item of merchandise available for purchase by the person holding the card, e.g. a suit of clothes or a toy train, or a tennis racket. Each card also specifies the price of the item depicted on the card.

Each branch path 13 has five spaces 37 thereon marked with a specific item of merchandise. There are thus forty specific items available for purchase (five items per store). There are forty corresponding cards in the pack of merchandise cards 39. Each card in the pack 39 has a different merchandise item illustrated or depicted thereon. The price of each item is printed on the respective card, e.g. sixty dollars for a toy train or forty dollars for a tennis racket.

Each player is permitted to purchase only the specific items depicted on the cards he/she has acquired by picking from the stack of cards 39. An item is purchased by landing the respective token on the particular designated space 37 in the particular store (branch path 13) of interest. Generally, when a player receives a card from pack 39 he/she will on the next turn roll the dice and move his/her token toward the corresponding space 37 in the appropriate branch path 13 in order to acquire the merchandise item.

As each player purchases a merchandise item (by landing his/her token on the appropriate space 37 and paying the appropriate dollar amount to the bank) the player records the purchase on a sheet of paper 43 (FIG. 3), herein termed a frequent shopper card. The winner is the player who accumulates the largest dollar value of merchandise in a given time period, or the player who first accumulates a given dollar value of purchases, e.g. five hundred dollars.

At the start of the game each player can be given a certain amount of play money with which to make purchases, e.g. two hundred dollars. Each player's money supply can be augmented by the player landing his/her token on one of the eight cash machine card spaces 23, and operating the spinner 21.

In order to add another factor into the game, there is another group of spaces 25 spaced along main path 11. Each space 25 is termed a surprise card space. A player landing his/her token on any space 25 is directed to pick the top card from a pack of cards 45 positioned on board 10. Each card in pack 45 directs the player to perform a specific act before the next player takes his/her turn. Following are some specific directions that might be contained in the cards in pack 45.

| | |
|---|---|
| You check your watch. You are supposed to be at Don's Discount Clothing right now to meet your friends. Go directly there. | You have been spending too fast so next time you hit a Cash Machine space forfeit that turn. |
| You realize you have lost an item while Lunching at Tasty Temptations. Remove one item from your Frequent Shipper Card | KEEP THIS CARD<br>Keep this card until next merchandise purchase and take $20.00 off the price marked on the card |
| Left package in the Restroom when you were there last. Go directly to Restroom area to pick it up. | Got tired and thirsty.<br>Go directly to drinking fountain area. |
| Keep this card until next Merchandise purchase and take ½ off its marked price on card. | You meet a friend that you owe $5.00 to. Choose one player from the board to go to Tasty Temptations to receive an item. |
| Stopped to freshen up.<br>Go directly to Restroom area. | While trying on an outfit you left a package in the dressing room.<br>Take one item off your Frequent Shopper card. |
| You are short on cash for an item you want. Your first choice is your loving brother. Choose one player and meet him in a store. call him your brother and make a purchase at his "loving" expense. | You have been using your time and money so wisely that you may go directly to "Tasty Temptations" for an item of your choice. |
| You were supposed to meet your mom for lunch at noon. Just as you get your turn in line you have to leave.<br>Forfeit one item. Better luck later! | Keep this card until you land on a cash square and then take 2 spins at the Cash Machine.<br>Return to pile when used. |
| You see your grandmother at the Mall and she gives you $200.00 she was going to send you for your birthday. | You forgot to get your uncle's birthday present. Go back four stores. |
| You are such a wonderfully kind person that your helping an older lady with her too many packages gains you a $50.00 "Thank You." | If you are playing the game wisely, you know what is going on with all the other players. Pick one player and send him to a store of *YOUR* choice.<br>(Probably one he doesn't need!!!) HAVE FUN. |
| KEEP THIS CARD!<br>Meet mom at the Mall. She goes with you to your next merchandise item and puts it on her credit card for you. Keep this item free. Return both cards to their piles. | You have "shopped till you dropped." Go to the bench rest area. |
| This is your big chance to get ahead if you are falling behind in your shopping. Choose one Merchandise Card—go directly to that store on the card and make your purchase.<br>It's getting late, the Mall will close soon. Don't fall behind. Draw two Merchandise Cards now. Hurry—Hurry—Hurry. | While shopping, you run into "good ol' dad", and he gives $200.00 just because you're you. |

The various cards add another factor into the game, and in some cases increase the chances of winning the game.

Variations can be incorporated into the game to add interest and suspense. Novel features of the game are recited in the appended claims.

What is claimed is:

1. A board game comprising a board marked to define an endless main path simulating the main corridor of a shopping mall, and a plurality of endless branch paths simulating individual stores in the shopping mall; each branch path having its own store entrance connection to the endless main path; each path having subdivider markings thereon defining discrete spaces for accommodating player tokens advanceable along the respective path; a first group of spaces in the main path being marked to direct the player to a cash machine spinner means; a second group of spaces in the main path being marked to direct the player landing thereon to receive a card entitling the player to purchase an item of merchandise by moving a token to a specified space in one of the branch paths; some of the spaces in each branch path being marked to indicate a specific merchandise item available for purchase when a player's token lands thereon; and a cash spinner means having a spinner and a series of markings denoting different dollar amounts receivable by the player operating the spinner.

2. The board game of claim 1, and further comprising a first pack of cards positionable on said board; each card in said pack having a merchandise item and price thereon; each card being awardable to a player landing on any space in the aforementioned second group of spaces.

3. The board game of claim 2, and further comprising a third group of spaces in the main path marked to direct the player landing thereon to receive a surprise card directing the player to take some specific action; and a second pack of cards positionable on said board; each card in said second pack containing a specific act to be performed by the player receiving said card.

4. The board game of claim 1, wherein said main path is located in a central area of the board, and the branch paths are disposed in the space surrounding the main path.

5. The board game of claim 4, wherein each path has a rectangular configuration.

6. The board game of claim 3, wherein one of the spaces in the main path is marked to designate a restroom, another space in the main path is marked to designate a pay phone, and a further space in the main path is marked to designate a drinking fountain.

7. The board game of claim 6, wherein some of the cards in the second pack of cards direct the player to proceed to the restroom or to the pay phone or to the drinking fountain.

8. The board game of claim 1, wherein said endless main path is a rectangular path located in a central area of the board, said branch paths being disposed in an annular space surrounding the main path; said cash spinner means being located in the space circumscribed by said endless main path.

* * * * *